US009468892B2

(12) United States Patent
Harris et al.

(10) Patent No.: US 9,468,892 B2
(45) Date of Patent: Oct. 18, 2016

(54) MODULAR CHEMICAL DISPENSING ASSEMBLY

(71) Applicant: Hydra-Flex, Inc., Burnsville, MN (US)

(72) Inventors: Jaime L. Harris, Rosemount, MN (US); Karl J. Fritze, Hastings, MN (US)

(73) Assignee: HYDRA-FLEX, INC., Burnsville, MN (US)

( * ) Notice: Subject to any disclaimer, the term of this patent is extended or adjusted under 35 U.S.C. 154(b) by 0 days.

(21) Appl. No.: 14/617,667

(22) Filed: Feb. 9, 2015

(65) Prior Publication Data

US 2015/0224461 A1 Aug. 13, 2015

Related U.S. Application Data

(60) Provisional application No. 61/936,995, filed on Feb. 7, 2014.

(51) Int. Cl.

| | |
|---|---|
| ***B01F 13/10*** | (2006.01) |
| ***B01F 5/04*** | (2006.01) |
| ***B01F 15/00*** | (2006.01) |
| *B08B 3/02* | (2006.01) |

(52) U.S. Cl.

CPC ..... *B01F 5/042* (2013.01); *B01F 5/0428* (2013.01); *B01F 15/00733* (2013.01); *B01F 2215/008* (2013.01); *B08B 3/026* (2013.01)

(58) Field of Classification Search

CPC B01F 5/042; B01F 5/0428; B01F 15/00733; B01F 2215/008; B08B 3/026

USPC ..... 222/144.5, 145.5, 180, 181.1–181.3, 222/136, 143, 630; 141/104, 105, 236

See application file for complete search history.

(56) References Cited

U.S. PATENT DOCUMENTS 4,218,013 A * 8/1980 Davison ..... B05B 7/12 137/889
4,356,937 A * 11/1982 Simon ..... B67D 1/0078 222/129.2
4,691,850 A * 9/1987 Kirschmann ..... B01F 13/1055 222/144.5
4,874,113 A 10/1989 Schmidt (Continued)

*Primary Examiner* — Donnell Long
(74) *Attorney, Agent, or Firm* — Dorsey & Whitney LLP

(57) ABSTRACT

A chemical dispensing system including a rack based system that can hold a plurality of chemical dispensing containers. The chemical dispensing containers can make use of concentrates or hyper concentrates of chemicals allowing smaller capacity containers. The rack based system can include a modular rack that is configurable to hold a desired number of containers. Using the modular rack, the containers can be easily ganged together to increase capacity or build in redundancy for one or more of the chemicals through the configuration of a rack manifold constructed of individual manifold segments. Within the manifold, various flow paths can be linked or terminated between adjacent manifold segments and chemical containers.

10 Claims, 16 Drawing Sheets

(56) References Cited

U.S. PATENT DOCUMENTS 5,060,825 A 10/1991 Palmer et al.
5,152,430 A 10/1992 Ruiberriz de Torres
5,255,820 A * 10/1993 Thomas ..... B67D 7/74 222/1
5,259,557 A 11/1993 Spriggs et al.
5,344,074 A * 9/1994 Spriggs ..... B01F 5/0403 137/614
5,351,875 A * 10/1994 Rhine ..... B67D 7/02 222/132
5,544,810 A * 8/1996 Horvath, Jr. ..... B05B 7/2443 239/10
5,584,327 A 12/1996 Thomas et al.
5,651,398 A * 7/1997 Decker ..... B67D 7/344 137/892
5,881,918 A 3/1999 Eichler
6,532,998 B2 3/2003 Beldham et al.
6,901,946 B2 6/2005 Frazier
6,978,911 B2 * 12/2005 Floyd ..... B01F 5/0403 222/1
7,303,096 B2 * 12/2007 Speight ..... B67D 1/10 222/143
7,422,038 B2 9/2008 Boler, Jr.
8,087,596 B2 1/2012 Mennenga
8,096,429 B2 1/2012 White
8,499,979 B2 8/2013 Sand
8,584,900 B2 * 11/2013 Metropulos ..... B67D 1/0888 222/129.1
2002/0092925 A1 * 7/2002 Hubmann ..... B01F 5/0413 239/310
2005/0051197 A1 * 3/2005 Wadsworth ..... A61L 2/18 134/26
2005/0051577 A1 * 3/2005 Loeb ..... B01F 5/0077 222/145.6
2005/0145719 A1 * 7/2005 Bertucci ..... B05B 15/06 239/302
2006/0109736 A1 * 5/2006 Neto ..... B01F 5/0413 366/69
2006/0118139 A1 * 6/2006 Fausnight ..... B08B 3/026 134/26
2006/0289571 A1 * 12/2006 Saxman ..... F01P 11/06 222/630
2007/0012639 A1 1/2007 Bixler
2011/0278324 A1 * 11/2011 Kilian ..... B67D 7/04 222/135
2014/0293735 A1 * 10/2014 Vidakovic ..... B01F 15/00733 366/245

* cited by examiner

MODULAR CHEMICAL DISPENSING ASSEMBLY

RELATED APPLICATION

The present application claims the benefit of U.S. Provisional Application No. 61/936,995 filed Feb. 7, 2014, and entitled "PACK RACK", which is incorporated herein in its entirety by reference.

FIELD OF DISCLOSURE

The present invention is directed to chemical dispensers and related methods of dispensing. More specifically, the present invention is directed to chemical dispensing systems including a mounting rack for holding chemical containers that allows for mixing or dosing of chemicals into a motive fluid such as in a car wash.

BACKGROUND OF DISCLOSURE

A variety of chemical dispensing systems exist in the art. For example, one conventional system utilizes a dip tube or "stinger" that is inserted so as to be positioned proximate a bottom of the container. The stinger can have a "foot valve", which include a check valve as well as a filter/screen to prevent contaminants/particulates from being inadvertently introduced from the bottom of the container. Typically, chemicals can be supplied in containers having various capacities such as, for example, 5 gallon, 30 gallon or 55 gallon containers. The use of stingers can be disadvantageous in that they can be quite messy, can expose workers to the chemicals and often can't feed all of the chemical form the containers. Other disadvantages associated with conventional chemical dispensing systems including the difficulty in shipping, moving and otherwise handle large chemical containers. In addition, the employees who work with these chemical dispensing systems often require additional instruction and training to properly and safely change and interconnect the containers with the dispensing system, which can include chemical mixing or dosing systems.

As such, it would be advantageous to improve upon existing chemical dispensing systems to improve upon existing handling requirements, while at the same time providing additional safety and ease of use to employees working with these chemical dispensing systems.

SUMMARY OF DISCLOSURE

A representative embodiment of an improved chemical dispensing system of the present invention comprises a rack based system that can hold one or more chemical dispensing containers for use in representative dispensing environments such as, for example, car washes and other chemical dispensing applications. The chemical dispensing containers can make use of concentrates or hyper concentrates of chemicals allowing smaller capacity containers, for example, about 2.5 gallons or less. The smaller capacity containers have a lower weight allowing for easier shipping and handling. In some embodiments, the smaller capacity containers can include one or more handles to enhance ergonomics during lifting and positioning. The rack based system can further comprise a modular rack that is configurable to hold a desired number of containers, for example, a minimum of two containers and a maximum of seven containers. Using the modular rack, the containers can be easily ganged together to increase capacity or build in redundancy for one or more of the chemicals through the configuration of a rack manifold using a plurality of manifold segments. Within the manifold, various flow paths can be linked or terminated between adjacent manifold segments and chemical containers.

One advantage of the chemical dispensing system of the present invention involves the use of chemical dispensing containers that utilize concentrates or hyper concentrates of chemicals. By utilizing concentrates and hyper concentrates of chemicals, chemical containers can be smaller in capacity, size and weight allowing for ease of handling and shipping, reduced floor space requirements, simpler installation and replacements and increased safety relative to both handling and chemical exposure. The chemical dispensing containers can include a dry change chemical connection to directly connect to connections on a modular rack allowing for a dry connection to a flow path and no risk of operator exposure to the chemical. In addition, the chemical dispensing containers can be fabricated of disposable or recyclable materials that allow for conventional disposal methods. Preferably, the chemical dispensing containers can be formed from low cost materials.

In one representative embodiment, a chemical dispensing container will feed chemical from an insert placed in a filler neck of the chemical dispensing container. The insert can have a foot that functions like a straw to allow access to all of the chemical within the container. An operator can remove a container shipping cap that otherwise covers the insert, wherein the insert is permanently attached to the container, for example, by welding, molding or bonding the insert to the container using suitable process such as ultrasonic welding, heat welding, spin welding, adhesive bonding and other known techniques.

In a representative embodiment, a container can comprise a 2.5 gallon HDPE container and a Rieke SC76 70 mm shipping cap or alternatively a 63 mm shipping cap. Once the shipping cap has been removed from the container, an operator can load the container onto the modular rack. A tray on the modular rack is configured to align and guide loading of the container such that the insert engages a male dry connect receiving component or "spud" on the modular rack. In some embodiments, the modular rack including the trays can be formed from Polyethylene to provide chemical resistance to the chemical dispensing system. In some embodiments, the tray can engage the modular rack or be otherwise fabricated to support each chemical dispensing container at an angle, for example, an angle of 5 to 10 degrees relative to a horizontal axis to assist feeding all of the fluid to the insert. A filler neck (or finish) of the chemical dispensing container can be positioned close to an outside wall of the chemical dispensing container or a dip tube (or foot, or straw) could be used on the insert, such that all of the concentrated chemical can feed out of the chemical dispensing container due to a feeding mechanism being at a lowest point in the chemical dispensing container when loaded onto the tray and fluidly interconnected with the modular rack. In some embodiments, the container insert can be made removable for refilling or reuse of the chemical dispensing container.

In a representative embodiment, a container insert can include a check valve that prevents fluid from leaving form the dispensing container prior to or during loading of the dispensing container onto a tray or in the event that the dispensing container is replaced or otherwise removed for maintenance or chemical change. The check valve is generally physically opened during interconnection of the dispensing container with the modular rack by a mating part or "spud" assembly on the modular rack. The spud assembly can also include a check valve to prevent unwanted chemical, motive fluid or solution from leaking from the flow paths within the modular rack when dispensing containers are disconnected from the modular rack. Through the use of check valves within each dispensing container as well as each spud assembly, attachment and removal of the dispensing container relative to the modular rack can be performed without any significant fluid loss improving both appearances and safety. The insert check valve is generally designed to be low cost while being chemically resistant. In one embodiment, the insert check valve can comprise a check ball and an elastomeric o-ring. In another alternative embodiment, the insert check valve can comprise a biasing spring and check poppet having a poppet seal that can provide a fluid tight seal bet is between a soft plastic like low density PE and the insert parent material.

In another representative embodiment, a container insert can further comprise a container vent including a membrane such as, for example, a PTFE membrane. The container even can provide the convenience of not having to open a secondary vent while the membrane prevents any splashing of the chemical concentrate following removal of the shipping cap. In an alternative embodiment the membrane can be positioned to be higher than a fluid level within the dispensing container so as to allow a lower container to refill from an upper container that is ganged to the lower container through flow patch defined within the modular rack. In some embodiments, a dispensing container can include a conventional vent or a second cap in a higher location related to the container insert.

In a representative embodiment, a chemical dispensing system can comprise a modular rack having a spine or manifold, wherein the spine is modular in design and each spine or manifold segment can be selected and otherwise connected with adjacent manifold segments to define a manifold member having one or more internal flow channels accommodating a high pressure motive fluid such as water as well as concentrated chemical that can be fed to other levels or for dispensing from the modular rack. Each manifold segment can be connected to adjacent manifold segment using a variety of suitable manifold interconnectors. In one representative embodiment, the connectors will define a continuous flow patch allowing for free flow of chemical between manifold segments. In this arrangement, two or more chemical dispensing containers can be fluidly joined together by using flow though manifold segments to increase the capacity of the chemical available on the modular rack. Typically the lowest manifold segment in a gang of similar chemical containers would be of the dispensing type. Chemical can then feed by gravity into the manifold, such that the top dispensing container in the gang would empty first and then could be replaced before the lower joined dispensing containers of similar chemical could be emptied assuring a constant flow of chemical from the stand even though one or more chemical containers were empty. Alternatively, the manifold interconnector can terminate or otherwise block the chemical flow channel between adjacent manifold segments so as to isolate chemical flow between adjacent manifold segments.

In one representative embodiment, a modular rack can include manifold segments defining two or more flow channels within the manifold, for example, a high pressure flow channel capable of operating with a high pressure motive fluid such as water at pressures of 50-250 psi while a second low pressure flow channel allows for chemical feeding from the chemical dispensing containers. Each manifold segment can be fabricated from a chemical resistant material such as cPVC or HDPE. Preferably, the manifold provides some flexibility to promote alignment of the spud assembly to the container insert for easy loading. Flexibility can be imparted to the manifold through the use of manifold interconnector between adjacent manifold segments. In some embodiments, individual spud assemblies connect to the manifold segments with a screw thread. Each spud assembly allows chemical to feed from the associated dispensing container(s) into the appropriate chemical flow channel. In some embodiments, the low pressure chemical channel can be vented to allow the low pressure channel to fill with chemical to a height of a container level. This can be advantageous if a dispensing rate from the spine temporarily outpaces the dispensing rate out of the container, i.e. the manifold could act as a small, short-term chemical reservoir. In addition, the height or pressure of the chemical fluid column within the low pressure channel might be measured to allow for a "gas gauge" or monitor of chemical remaining within the chemical dispensing container(s).

In a representative embodiment, the modular rack will include a manifold utilizing quick release chemical injectors, for example those disclosed in U.S. Pat. Nos. 8,322,367 and 8,807,158, which are herein incorporated by reference in their entirety. The injector can be configured to connect to the manifold such that the injector can be fed both high pressure water and low pressure chemical. The quick release injector can be disconnected from the manifold for maintenance or replacement without the loss of water or chemical. The high pressure channel in the manifold can include a motive fluid valve allowing high pressure water to flow into the injector when chemical delivery is desired. The motive fluid valve can be pneumatically or electrically actuated and can be selectively controlled by a control processor. In some embodiments, a check valve would not be needed on the high pressure motive fluid side of the injector when the high pressure water valve was closed as the valve would prevent the escape of high pressure water as the injector is removed from the manifold.

In another representative embodiment, each chemical dispensing container can include a keying feature that interfaces with a modular rack to prevent the accidental introduction, mixing and use of different or unintended chemicals that can cause contamination or worse, an unintended chemical reaction. In some representative embodiments, the chemical dispensing system can use the keying feature with only the most volatile or hazardous chemicals. Alternatively, the keying feature can be utilized with each chemical and chemical container that allows for the use of only one chemical with a specific location or tray on the modular rack. In one representative embodiment, the keying feature can include the placement of one or more recessed bosses in the container that corresponds with an arrangement of one or more pins on the corresponding tray of the modular rack. In order to reduce manufacturing costs for differently keyed containers, the same number and pattern of recessed bosses could be formed on every container whereby the bosses could be selectively filled with one or more plugs to create specific boss patterns. When the container is positioned in the correct and corresponding tray, the pins on the tray align with any recessed bosses/unplugged bosses allowing the container to fully seat within the tray, whereby the spud assembly is allowed to fully and fluidly engage the insert and dispense chemical.

In another representative embodiment, a modular rack system of the present invention can further comprise an engagement feature providing tactile feedback that confirms when a chemical container is fully seated on a tray, fluidly engaged with the modular rack and ready to dispense chemical. The modular rack system can further comprise a retaining or locking mechanism that provide a retention force that prevents unintended disengagement of the chemical container from the modular rack. In one representative embodiment, the spud assembly can include a segmented collar with teeth that engages a screw thread on the filler neck of the chemical container. In another embodiment, the chemical container can be formed/molded with a recess that engages a similar protruding feature on the tray. The chemical container can be formed a material that is relatively flexible and/or deformable such that an operator can manipulate the chemical container to "snap" into place. In another embodiment, the modular rack can include a sensor such as, for example, a proximity switch or photo eye that indicates the presence of a chemical container on a that level to a remotely located control system.

In another aspect, the chemical dispensing system can include an integrated monitoring system to help alert the user and/or a control system to differing chemical levels. In one embodiment, the chemical containers can be designed to be clear or opaque in one or more key, i.e. easily visible locations such that the user can quickly monitor and verify the chemical level visually. In another embodiment, the monitoring system can be automated and include a light, buzzer or similar alerting system to let the user know the chemical level is low. In a chemical dispensing system utilizing an advanced control system, the alerting function can be connected, either directly or via a wireless protocol, to a remotely located control/monitoring station or even to a mobile station such as, for example, a portable processing device such as a smart phone, a tablet computing device of a laptop computer. In one embodiment the monitoring system can include one or more ultrasonic transducers that are individually capable of measuring liquid levels within each chemical container. In some embodiments, the transducer can report a liquid level continuously or alternatively, be set to alarm when a threshold value is reached. In another representative embodiment, the monitoring system can use a simple float valve in each container to measure chemical level. When a threshold value is achieved, for example, 20% chemical remaining in the container, a light on the modular rack is illuminated. In yet another embodiment, a thermistor with a small heater can be immersed in the fluid of each chemical container. The thermistor and heater assembly can be positioned at a height in the column of fluid corresponding to a fluid level to be detected. When the fluid level drops below that level, thereby uncovering the thermistor and heater assembly, the heater assembly can no longer transfer its energy to the surrounding fluid and so heats the thermistor. The resistance of the thermistor will change signaling that the fluid level is at the predetermined level. In another representative embodiment, the monitoring system can include a pressure gauge connected to the chemical fluid column in the modular rack. As the height of the fluid column decreases within the flow channel of the modular rack as containers are emptied in the modular rack, the pressure decreases signaling an increasingly empty condition. The pressure of the fluid column can be correlated to a chemical volume or amount of fluid remaining and reported to the operator.

In a representative embodiment, a modular rack can be formed of molded or machined polymeric materials. In some embodiments, the modular rack and the individual manifold segments can be formed of polyethylene or other polymers that are selected for their chemical resistance. The modular rack can to a plurality of trays that are similarly formed of a polymeric material that may be the same or different than the material used for the modular rack. In some embodiments, each tray can be configured to act as a drip tray and can include individual drains to collect any drips or spills.

In some embodiments of the modular rack, one or more individual manifold segments can be formed or fabricated to include integrated chemical dispensing. For example, these manifold segments can comprise an air actuated valve, and a quick release chemical injector with a metering orifice. The chemical injector can be used to precisely mix dispensed chemical with a motive fluid, which is typically pressurized water. When the air actuated valve opens, the motive fluid is introduced into the injector from a high pressure motive fluid channel defined within the manifold. The injector can comprise a venturi-style injector, wherein the flow of the motive fluid causes chemical to be pulled from the other low pressure channel within the manifold segments through a metering orifice. The metering orifice can be designed to be removable and easily replaceable such that the chemical mixing ratios can be easily changed. In one embodiment, the metering orifice can be installed using screw threads to allow for easy removal or replacement. The quick release injector can incorporate a check valves in the related manifold segment such that no or little fluid escapes the manifold when individual injectors are removed for maintenance and/or replacement.

In another representative embodiment, a cartridge can be utilized to retrofit an existing container to work with the present chemical dispensing system. The cartridge can define the container insert and can comprise a breathable membrane, a quick-dry connection and a check valve. The cartridge can be configured for welding into a container or alternatively, the cartridge can be added to a conventional container when it arrives at the customer. In some embodiments, the cartridge can replace the shipping cap, for example, the shipping cap can be unscrewed followed by screwing on the cartridge. The cartridge allows for existing containers to be used with the present chemical dispensing system by the container with a breathable membrane, a chemical tight seal and a check valve to prevent chemical spillage.

In one aspect, the chemical dispensing system of the present invention reduces chemical waste by increasing the amount of chemical removed from the containers and eliminating inadvertent spillage during connection and removal of chemical containers.

In another aspect, the chemical dispensing system of the present invention improves operational safety by reducing operator exposure to chemicals. In addition, the quick connect features of the chemical containers and modular rack provide for easy and robust fluid connections.

In another aspect, the chemical dispensing system provides for the use of chemical concentrates and hyper concentrates such that smaller containers that are easily transported and handled can be utilized. In addition, chemical containers can include ergonomic features such as, for example, handles that allow them to be loaded by an individual operator and require no special skills or strength to properly load.

In yet another aspect, the chemical dispensing system can utilize a modular rack that includes a reporting feature that can continually measure chemical levels/usage or provide a signal based on threshold levels being reached. The reporting feature can include a visible or audible reporting feature or alternatively, the reporting feature can provide a signal to a control/monitoring system.

In yet another aspect, the chemical dispensing system can include a configurable modular rack that allows for chemical supply redundancy, whereby containers can be ganged together such that individual containers can run dry without the chemical dispensing system running out of chemical. A user can double up on chemical containers having a comparatively higher usage rate or for chemicals that are deemed critical.

In another aspect, the chemical dispensing system can avoid the use of vent cap openings due to a permeable membrane.

In another aspect, the chemical dispensing system can include a keying feature that verifies fluid connections between chemical containers and spuds on a modular rack to prevent hazardous and/or reactive chemicals from being mixed or inadvertently introduced.

In yet another aspect, the chemical delivery system allows for the use of smaller containers to maximize floor space.

In yet another embodiment, the chemical delivery system can reduce and/or prevent chemical contamination due to the use of a quick connect design, keying features, integrated fluid channels and a modular rack design.

The above summary of the various representative embodiments of the invention is not intended to describe each illustrated embodiment or every implementation of the invention. Rather, the embodiments are chosen and described so that others skilled in the art can appreciate and understand the principles and practices of the invention. The figures in the detailed description that follow more particularly exemplify these embodiments.

BRIEF DESCRIPTION OF THE DRAWINGS

The invention can be completely understood in consideration of the following detailed description of various embodiments of the invention in connection with the accompanying drawings, in which.

Figure 1:
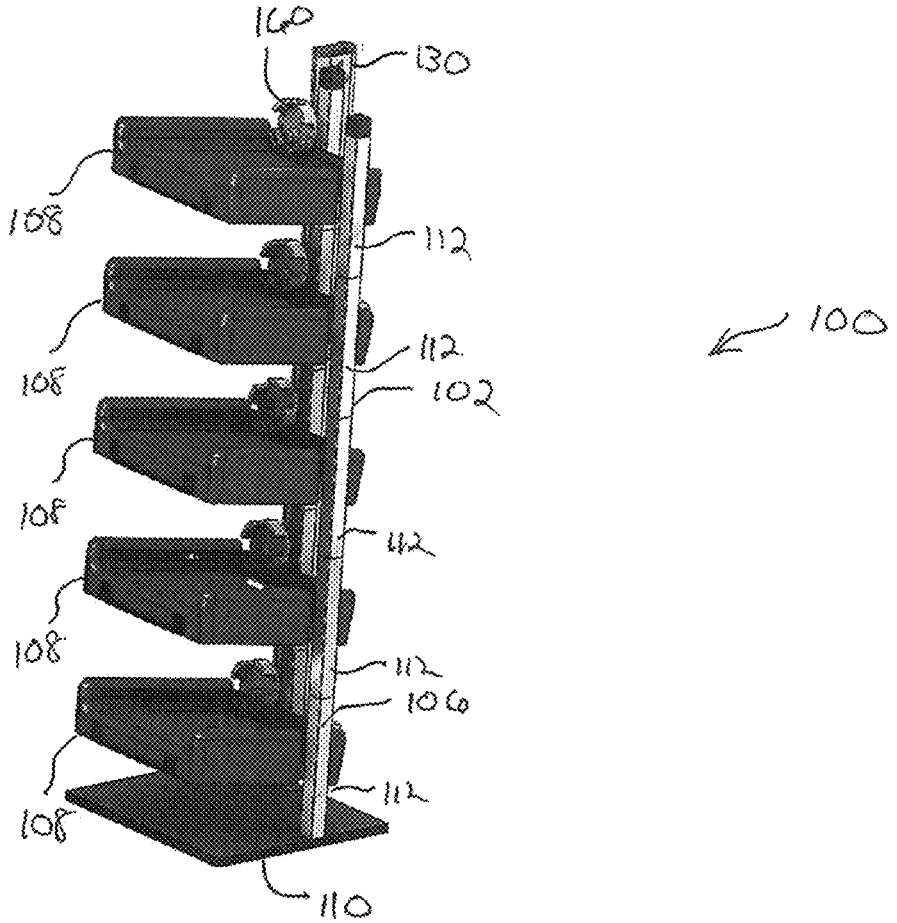
FIG. 1 is a perspective, front view of a chemical dispensing assembly according to an embodiment of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION OF THE DRAWINGS

Figure 12:
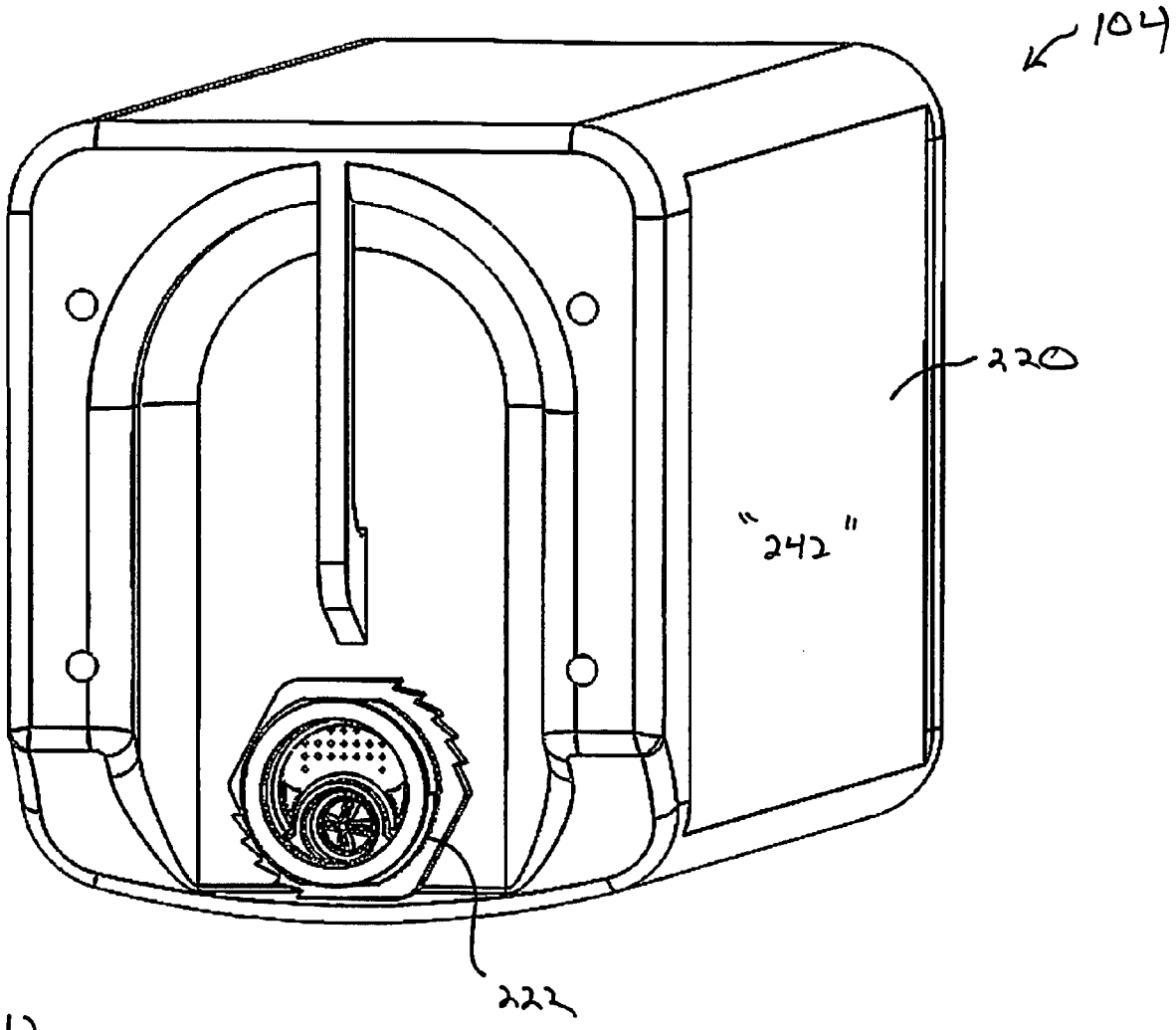
FIG. 12 is a perspective view of a container of the invention.
Figure 13:
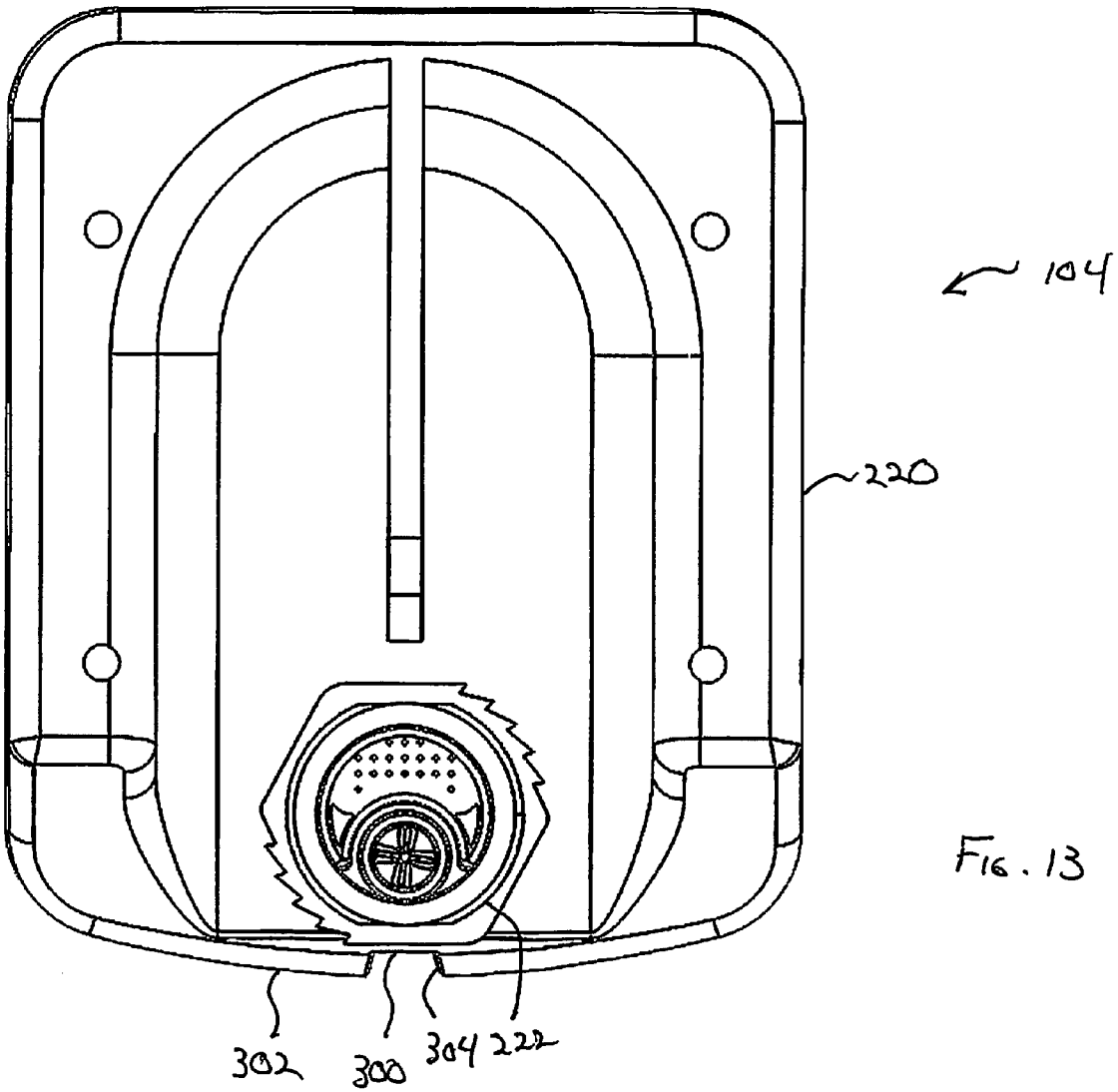
FIG. 13 is a perspective view of another embodiment of a container of the invention.
Figure 14:
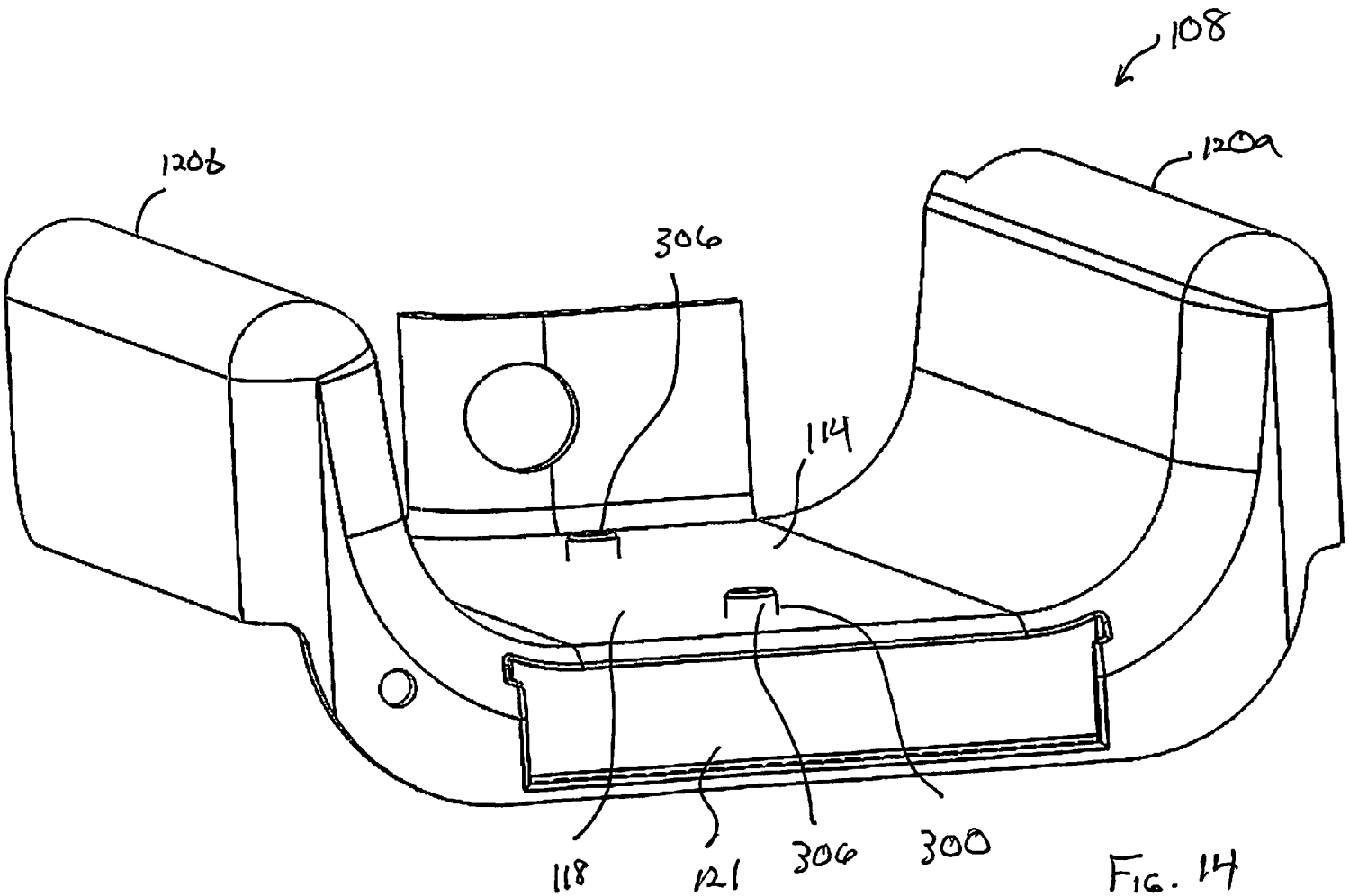
FIG. 14 is a perspective view of another embodiment of a tray of the invention.

As illustrated in FIG. 1, a chemical dispensing assembly 100 of the present invention can comprise a rack based system 102 for receiving a plurality of chemical containers 104 as shown in FIG. 12. Rack based system 102 generally comprises one or more vertical supports or spine members 106 to which a plurality of shelves or trays 108 are integrally attached and supported. Trays 108 are generally configures such that chemical containers 104 can be slidably placed and retained on each tray 108. Spine member 106 can include a base plate 110 coupled to the spine 106 at a lower most point of the rack based system 102. Typically, the base plate 110 will define the floor space occupied and required by the chemical dispensing assembly 100 and can provide an attachment point by which the rack based system 102 can be anchored to a floor or similar supporting surface. Spine 106 can be configured to have a desired height by forming it from a plurality of spine segments 112 to have a desired spine height, for example, using five spine segments 112 as shown in FIG. 1.

Figure 2:
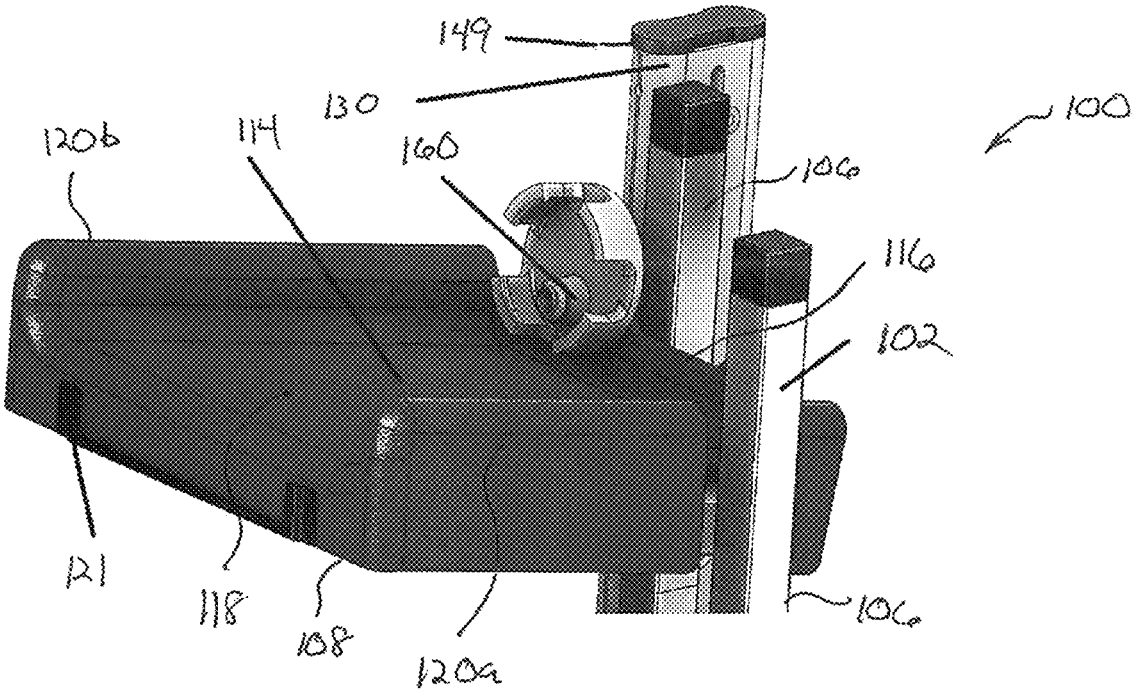
FIG. 2 is a front, perspective view of an upper portion of the chemical dispensing assembly of FIG. 1.
Figure 3:
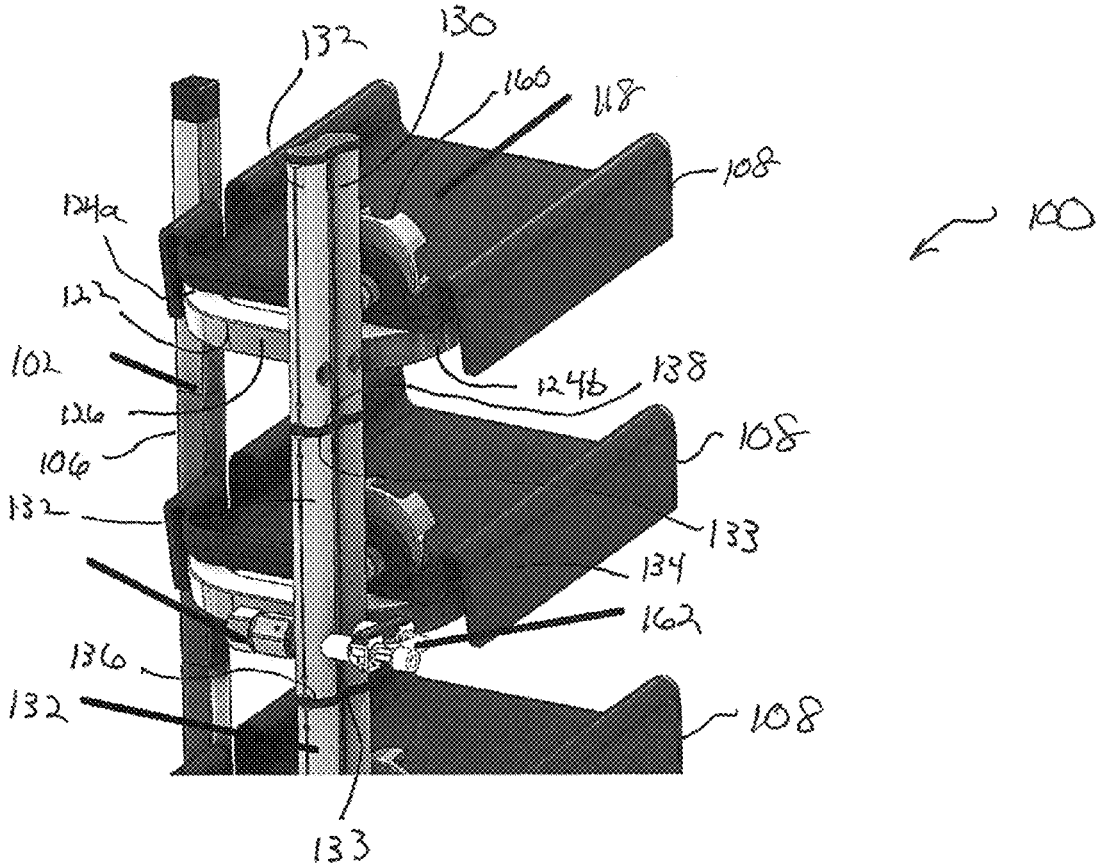
FIG. 3 is a rear, perspective view of the upper portion of the chemical dispensing assembly of FIG. 1.

Referring now to FIGS. 2 and 3, each tray 108 generally comprises a support portion 114 and a connecting portion 116. The support portion 114 is generally defined by a supporting surface 118 and a pair of side walls 120*a*, 120*b*. Support portion 114 can define a name plate 121 for displaying a chemical name/type to assist a user during replacement of empty containers 104. The connecting portion 116 can comprise a frame member 122 including a pair of connecting arms 124*a*, 124*b* and a backspan 126. The frame member 122 can be connected to the support portion 114 using suitable fasteners or for positioning the connecting arms 124*a*, 124*b* within cavities defined by the side walls 120*a*, 120*b* as shown in FIG. 3. Connecting arms 124*a*, 124*b* and backspan 126 can include one or more mounting apertures that allow for interconnection of each tray 108 to the one or more spine members 106.

Figure 4:
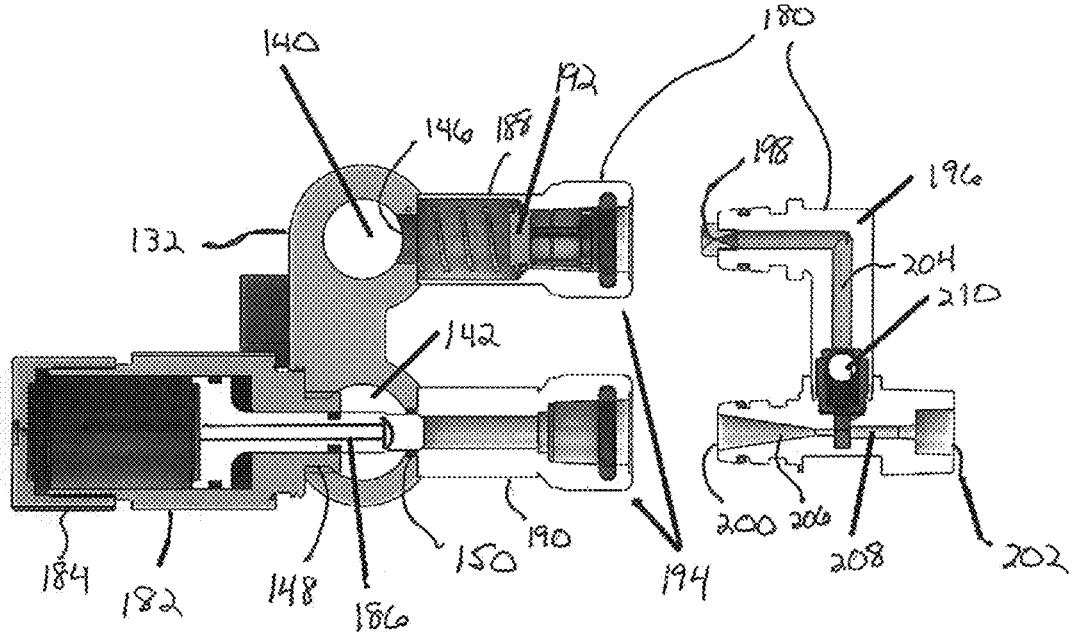
FIG. 4 is a section view of an injector assembly of the invention.
Figure 5:
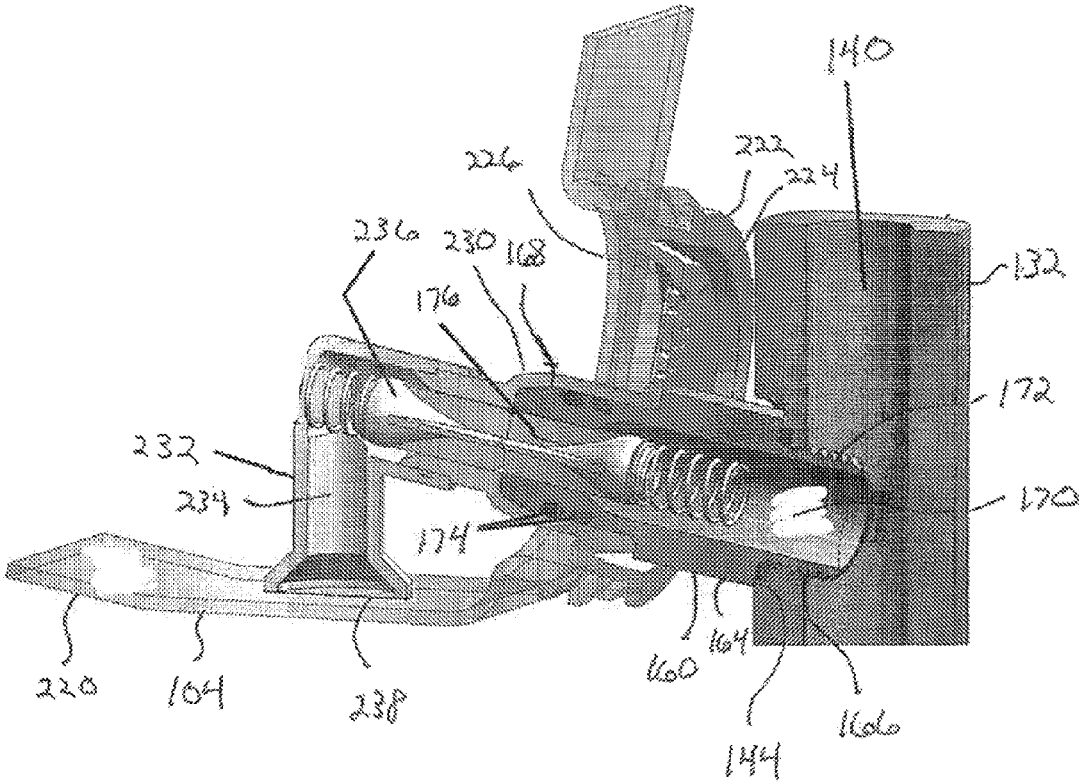
FIG. 5 is a partially hidden, section view of a spud assembly and a container of the invention.

Rack based system 102 further comprise a manifold member 130 that is generally formed and defined by selectively coupling a plurality of manifold segments 132 in interlocking, adjacent fashion using an interconnecting member 133. Typically, manifold member 130 will include the same number of manifold segments 132 as spine member 106 includes spine segments 112. While spine member 106 was further described as including five spine segments 112 as shown in FIG. 1, it will be understood that spine member 106 and manifold member 130, can comprise a minimum of two to a practical limit of seven or more spine segments 112 and manifold segments 132 respectively. Each spine segment 133 generally comprises an elongated body 134 having a lower end 136 and an upper end 138. The elongated body 134 can comprise extruded or molded components that are selectively formed of an appropriate metal or polymeric material. Defined within each manifold segment 132 is a chemical channel 140 and a high pressure water channel 142 as seen in FIG. 4. Elongated body 132 further defined a plurality of apertures that fluidly interconnect with the chemical channel 140 and high pressure water channel 142. These apertures include a spud mounting aperture 144 as seen in FIG. 5 and a chemical injector aperture 146 fluidly interconnected to the chemical channel 140 and a valve mounting aperture 148 and a water injector aperture 150 fluidly interconnected to the high pressure water channel 142. A topmost manifold segment 132 can include a manifold cap 149 to close off the chemical channel 140 and high pressure water channel 142.

Figure 6:
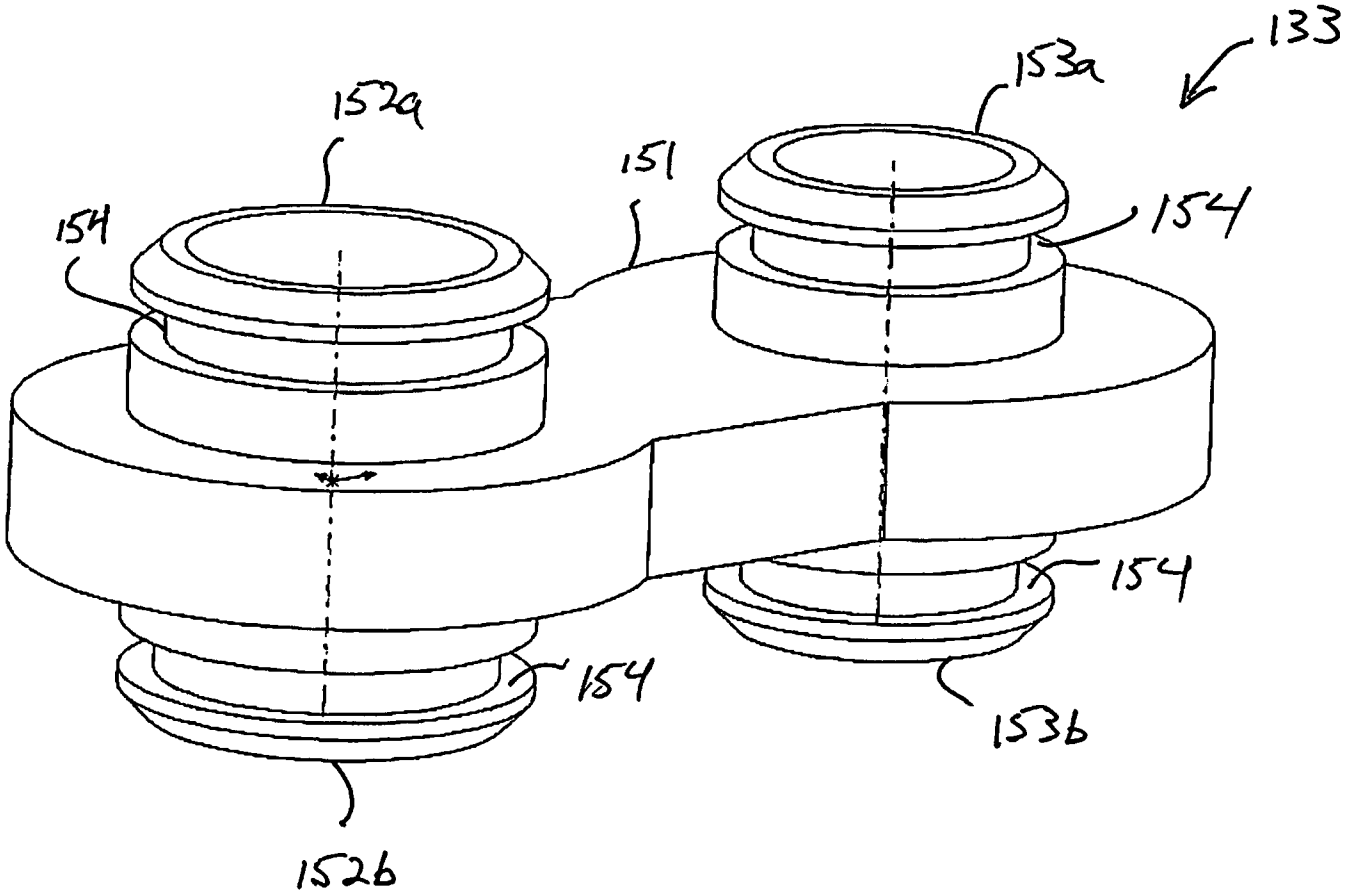
FIG. 6 is a perspective view of an interconnecting member of the invention.
Figure 7:
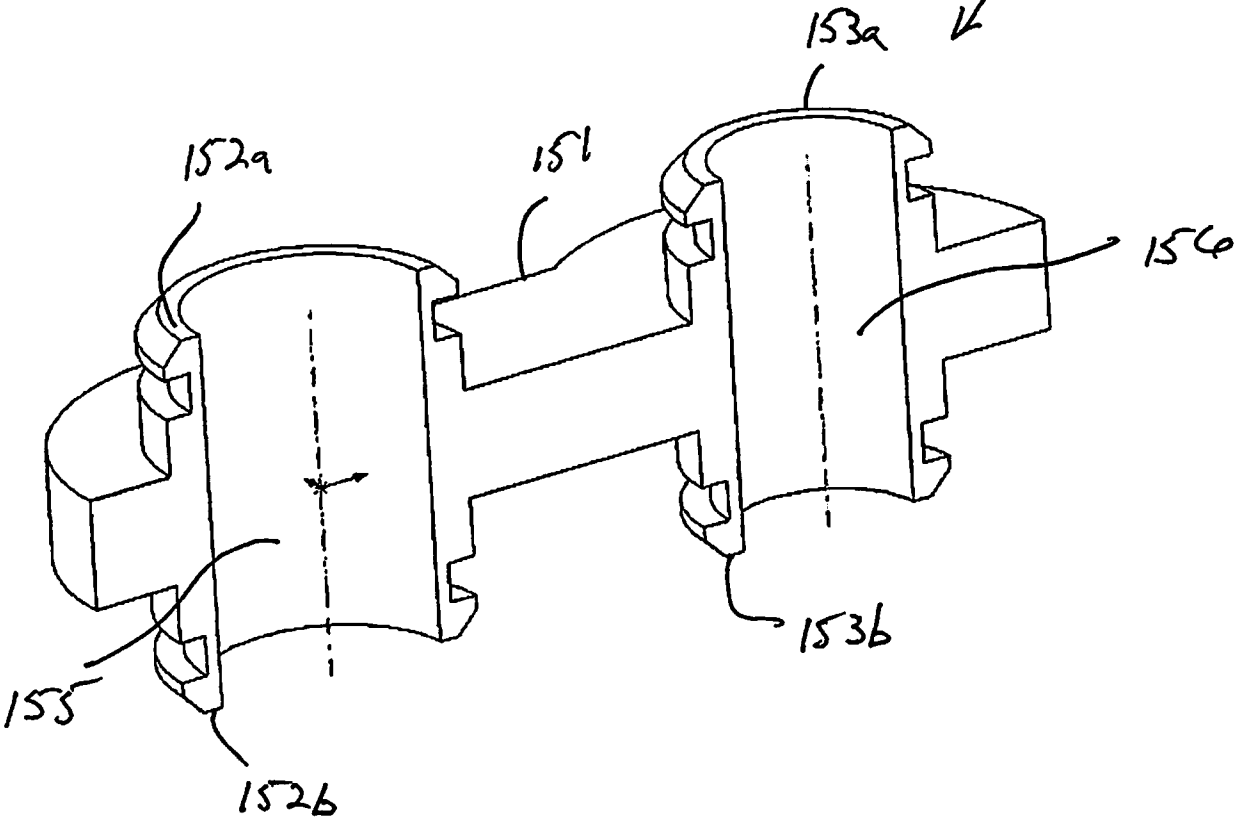
FIG. 7 is a section view of an embodiment of the interconnecting member of FIG. 6.
Figure 8:
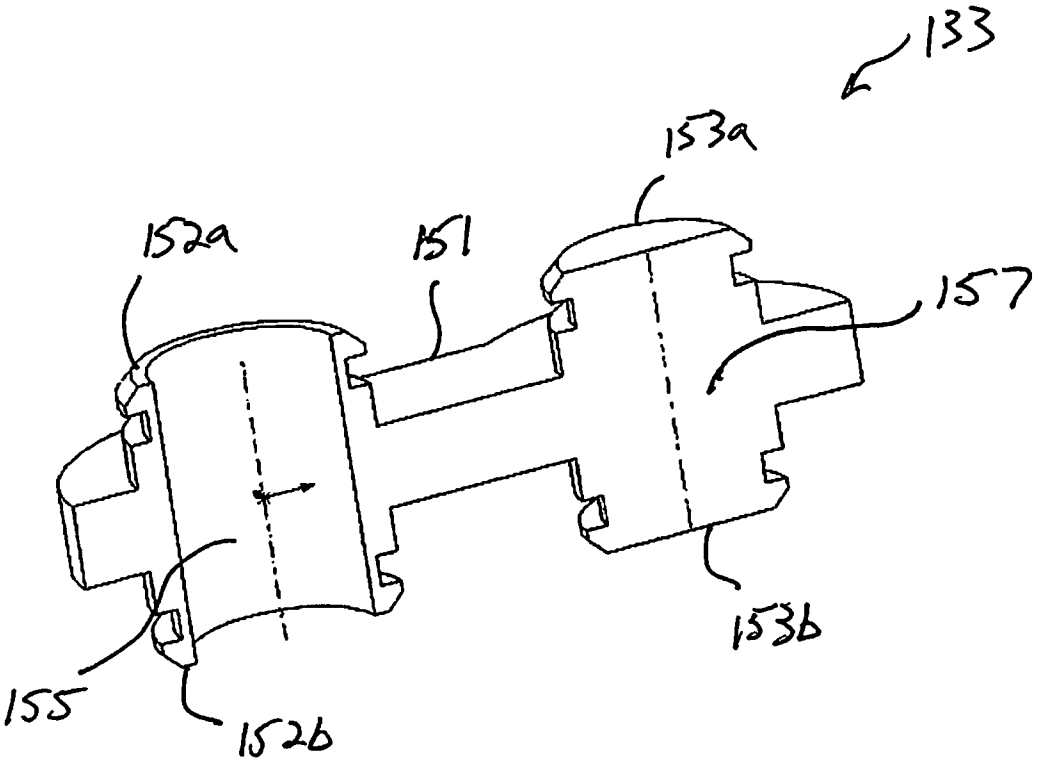
FIG. 8 is a section view of an embodiment of the interconnecting member of FIG. 6.

As shown in FIG. 6, interconnecting member 133 generally comprises a body 151 including a pair of high pressure channel barbs 152*a*, 152*b* and a pair of chemical channel barbs 153*a*, 153*b*, Each of the high pressure channel barbs 152*a*, 152*b* and the chemical channel barbs 153*a*, 153*b* include a sealing channel 154 into which an o-ring can be mounted. As seen in FIG. 7, a high pressure barb flow channel 155 is generally defined between high pressure channel barbs 152*a*, 152*b*. In addition, a chemical barb flow channel 156 can be defined between chemical channel barbs 153*a*, 153*b*. High pressure barb flow channel 155 and chemical barb flow channel 156 generally allow flow between the chemical channel 140 and the high pressure water channel 142 in adjacent manifold segments 132. In an alternative embodiment shown in FIG. 8, a chemical plug 157 can be defined between the chemical channel barbs 153*a*, 153*b* to prevent or isolated the flow of chemical between the chemical channels 140 of adjacent manifold segments 132. Generally, a user would want to use interconnecting member 133 that defines the chemical barb flow channel 156 when adjacent trays 108 are being ganged together to increase the holding capacity of the same chemical on the rack based system 102. A user would want to use interconnecting member 133 having the chemical plug 157 when adjacent trays 108 have different chemicals and it is desirable to isolate these different chemicals form one another and avoid mixing within the chemical channel 140. As the high pressure water within the high pressure water channel 142 will generally be used throughout the various levels of the rack based system 102, there is no need to have a high pressure plug between the high pressure channel barbs 152*a*, 152*b*.

Figure 9:
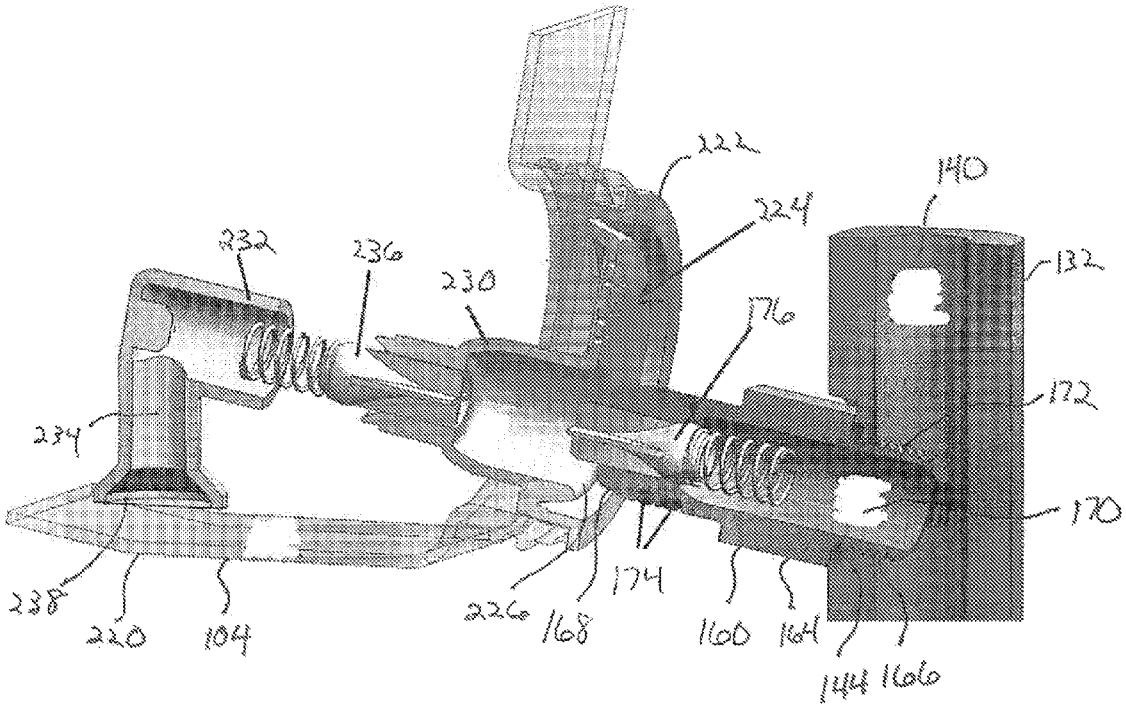
FIG. 9 is a partially hidden, section view of the spud assembly and container of the invention.

As shown in FIGS. 1-5 and 9, manifold member 130 can further comprise a spud assembly 160 and an injector assembly 162. Spud assembly 160 generally fluidly interconnects each chemical container 104 with the chemical channel 140. As seen in FIGS. 5 and 9, spud assembly 160 generally comprises a spud member 164 having a manifold connector 166 and a container connector 168 with a spud flow channel 170 defined there between. Manifold connector 166 can include a threaded connection 172 that can sealably connect with the spud mounting aperture 144. Container connector 168 can include one or more container seals 174, for example, o-rings. A spud check-valve 176 can be mounted within the spud flow channel 170 to prevent unintentional chemical flow from the chemical container 104 into the chemical channel 140.

Figure 10:
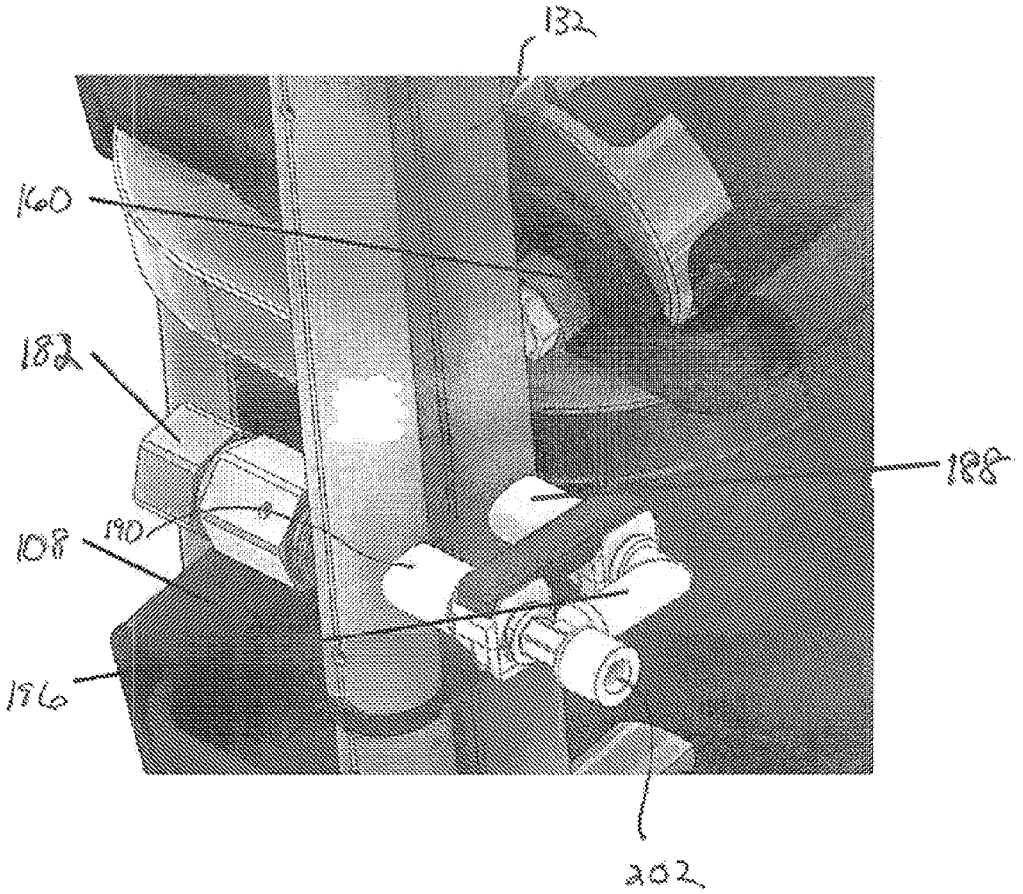
FIG. 10 is a rear, perspective view of the injector assembly of FIG. 4.
Figure 11:
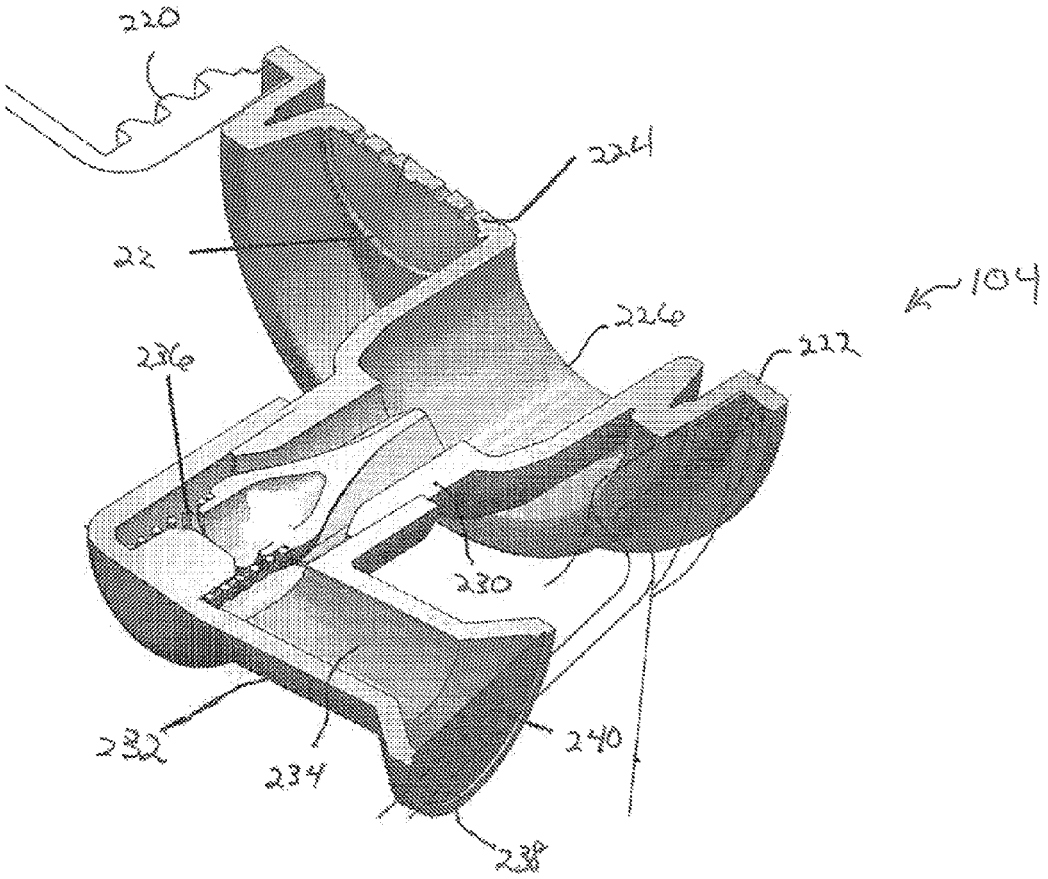
FIG. 11 is a partially hidden, section view of a container of the invention.

Injector assembly 162 as seen in FIGS. 3, 4 and 10 can generally comprise an injector body 180 and an injector control valve 182. Injector control valve 182 generally comprises an actuator 184 and a valve member 186. Actuator 184 is coupled to the valve mounting aperture 148 such that the valve member 186 can selectively allow high pressure water to flow from the high pressure water channel 142 and into the water injector aperture 150. Injector body 180 generally comprises a chemical flow member 188 and a high pressure water flow member 190. The chemical flow member 188 fluidly mounts to the chemical injector aperture 146 while the high pressure water flow member 190 fluidly connects to the water injector aperture 150. Chemical flow member 188 can comprise a chemical flow member check valve 192 Chemical flow member 188 and high pressure water flow member can define flow member connectors 194. Injector body 180 can further comprise a venturi injector body 196 including an injector inlet 198, a high pressure water inlet 200 and a mixed solution outlet 202. Venturi injector body 196 generally defines a chemical flow path 204, a high pressure water flow path 206 and a venturi throat 208. Within the chemical flow path 204 is a venturi check valve 210.

Chemical container 104 as illustrated in FIGS. 5, 9, 11 and 12 generally comprises a container body 220 and a container insert 222. Container insert 222 can define an insert surface 224 having an insert aperture 226 and an insert membrane 228. Container insert 222 can further comprise an internal insert projection 230 that fluidly connects to a foot member 232. Foot member 232 and internal insert projection 230 cooperatively device a container flow path 234. Within the container flow path 234 is a container check valve 236. Foot member 232 include a foot inlet 238 that can include a filter or screen 240 mounted over the foot inlet 238. Foot member 232 is preferably attached to the internal insert projection 230 such that the foot inlet 238 is proximate a lower most portion of the chemical container 104 such that chemical 242 can be completely emptied from the chemical container 104 during use.

In use, a user would first determine the number and amounts of chemical 242 that needed to be dispensed. For instance, a car wash installation might make use of a rack based system 102 having five different chemicals using five trays 108 as shown in FIG. 1. These five different chemicals could include, for example, a pre-soak agent, a wash detergent, a tire cleaner, a wax and a rinse agent. Generally, the user then constructs the spine member 106 and manifold member 130 of the appropriate number of spine segments 112 and manifold segments 132 respectively. When connecting the manifold segments 132, the user utilizes the interconnecting member 133 between each adjacent manifold segment 132 with the high pressure channel barbs 152*a*, 1522 being sealably received in each high pressure water channel 142 and the chemical channel barbs 153*a*, 153*b* being sealably received in each chemical channel 140. In the event that the user wishes to gang together adjacent trays, the use would use interconnecting member 133 with the chemical barb flow channel 156. Otherwise, the user would use the interconnecting member 133 with the chemical plug 157 to prevent chemical flow between adjacent manifold segments 132.

Next the user attaches the each tray to the appropriate spine segment 112 using the connecting portion 116. With the manifold member 130 assembled, the user attaches a spud assembly 160 to each manifold member 130 by attaching the manifold connector 166 to the corresponding spud mounting aperture 144. Next, the user attaches the injector assembly 162 to each manifold segment 132 by coupling the actuator 184 to the corresponding valve mounting aperture 148 and the injector body 180 to each manifold segment 132 by coupling the chemical flow member 188 to the chemical injector aperture 146 and the high pressure water flow member 190 to the water injector aperture 150. When the venturi injector body 196 is coupled to the injector body 180, the injector inlet 198 causes the chemical flow member check valve 192 to be biased to an open condition. Finally, the user positions the appropriate container 104 on each tray 108 such that the insert aperture 226 sealingly covers and engages the container connector 168. As the container 104 is connected to the spud assembly 160, both the spud check valve 176 and the container check valve 236 are biased to an open condition.

In operation, high pressure water is supplied to the manifold member 130, preferably at a lower most manifold segment 132 proximate the base plate 110 such that the high pressure water. A system controller generally provides a signal to selectively actuate the actuator 184, such that the valve member 186 is allowed to open and allow high pressure water to flow into the high pressure water flow member 190 and correspondingly through the high pressure water inlet 200 of the venturi injector body 196. As the high pressure water flows through the venturi throat 208, a venturi condition is created whereby a vacuum is applied to the chemical flow path 204 causing the venturi check valve 210 to open.

When the venturi check valve 210 is opened, chemical is drawn into the foot inlet 238 whereby it is filtered by the screen 240. The vacuum condition causes chemical to be drawn through the container flow path 234 and into the container connector 168 and through the spud flow channel 170. The chemical flows through the manifold connector 166 and into the chemical channel 140. Due to the vacuum condition, the chemical is drawn through the chemical channel 140 and into the chemical flow member 188. Finally, the chemical enters the injector inlet 198 where it is drawn into the venturi throat 208, where it is mixed with the high pressure water such that a chemical solution is dispensed from the mixes solution outlet 202 and to a desired point of application/use.

In some instance, it may be critical to have the proper chemical container 104 on the appropriate tray 108 and to make it difficult if not impossible to fluidly connect the wrong chemical container 104 to the spud assembly 160. One way to accomplish this is to fabricate the container 104 and specified tray 108 to include a keying feature 300 that prevents the container 104 from seating on the tray 108 if they are not keyed to one another. For instance, container 104 can be fabricated to have a floor surface 302 that defines bosses or channels 304 in the floor surface 302. Similarly, tray 108 can be fabricated to include one or more ridges or pins 306 that project upward from the supporting surface 118. When the bosses/channels 304 are aligned with the ridges/pins 306, the container 104 will slide onto the tray 108, whereby the floor surface 302 is flush with the supporting surface 118 and the container 104 is retained within the side walls 120*a*, 120*b*. If the bosses/channels 304 are misaligned with the ridges/pins 306, the container 104 will not properly reside on the tray 108 such that connection of the spud assembly 160 with the container insert 22 cannot be sealably accomplished.

Figure 15:
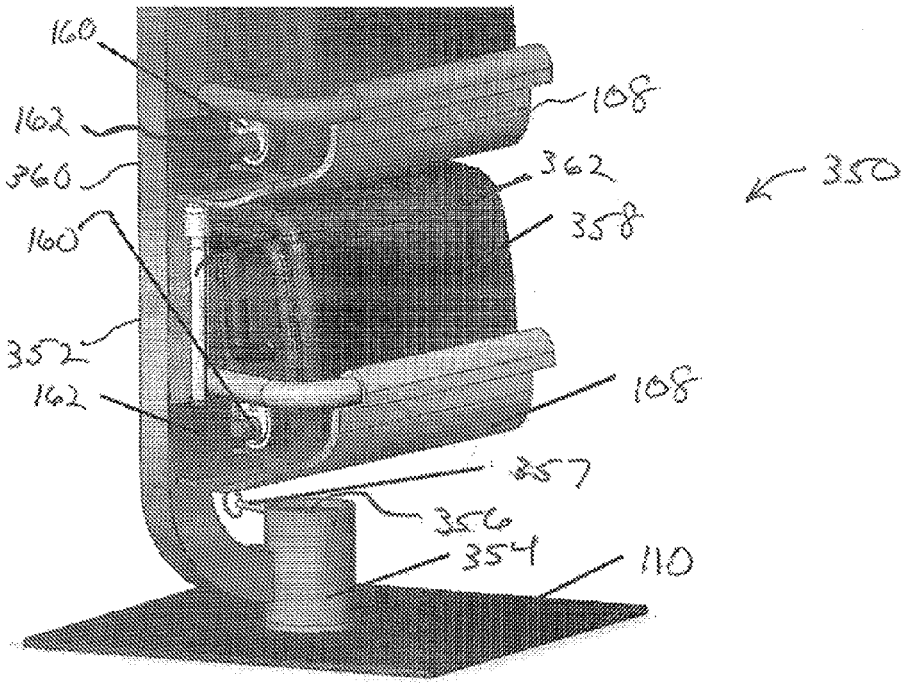
FIG. 15 is a rear, perspective view of a lower portion of a chemical dispensing assembly according to an embodiment of the invention.

In another alternative embodiment as illustrated in FIG. 15, chemical dispensing assembly 350 can substantially resemble the performance of chemical dispensing assembly 100 with various modifications to the manifold member 130. For example, chemical dispensing assembly 350 can comprise a manifold member 352 in which the trays 108 are directly mounted to the manifold member 352 as opposed to requiring spine members 106. As illustrated, manifold member 352 can include a lower receiver 354 that mounts over a mounting post 356 on the base plate 110. By removing a receiver pin 357 that otherwise locks the manifold member 352 within the lower receiver 354, a user can rotate the manifold member 352, and thereby the attached trays 108, to facilitate the removal and/or attachment of chemical containers 358. In order to handle the load of the trays 108 and chemical containers 358, the manifold member 352 can comprise one or more manifold segments 360. As shown in FIG. 15, the manifold segments 360 can be fabricated to not include the chemical channel 140. Instead, a chemical channel 362 can be formed of tubing 364 external to the manifold segment 360.

Figure 16:
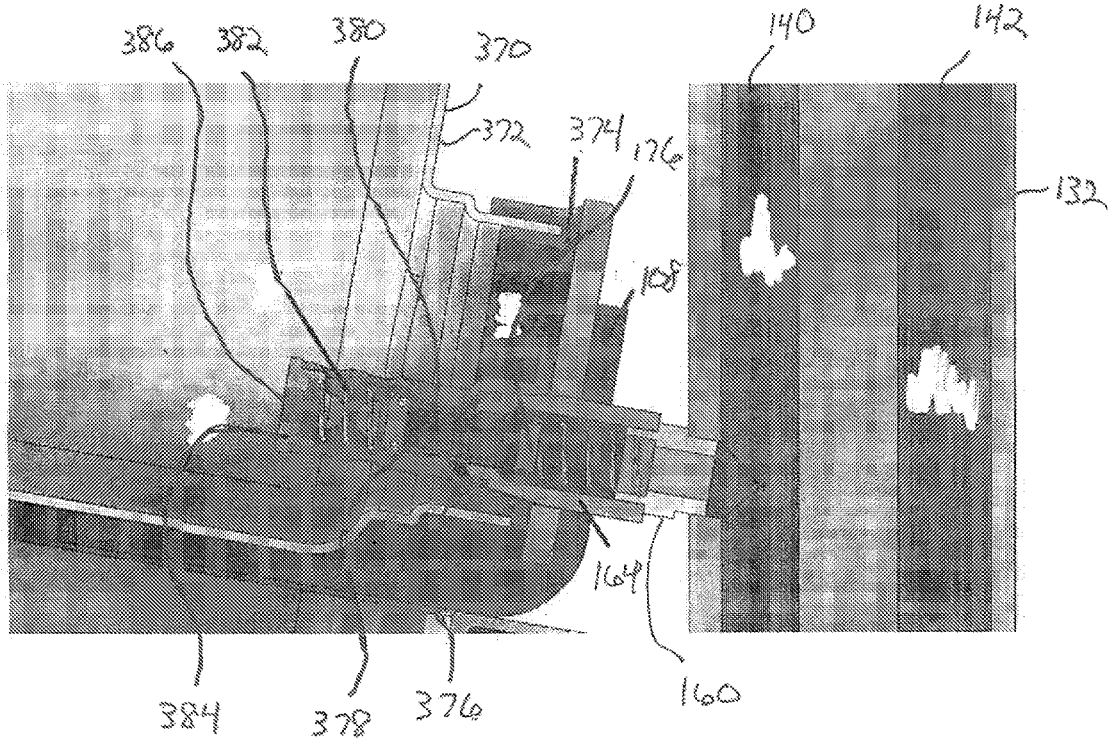
FIG. 16 is a partially hidden, section view of the spud assembly and a chemical container of the invention.

In another embodiment, an alternative embodiment of a chemical container 370 can be utilized with the spud assembly 160 as shown in FIG. 16. Chemical container 370 can comprise a container body 372 and a container insert 374. Container insert 374 can define an insert aperture 376 and an insert connector member 378 that define a container flow path 380. Within the container flow path 380 is a container check valve 382. Insert connector member 378 can define a container inlet 384 that can include an inlet filter or screen 386.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents.

The invention claimed is:

1. A chemical dispensing system, comprising:

a manifold member formed of at least two manifold segments, wherein each manifold segment defines a high pressure water channel and a chemical flow channel;

at least two trays, each tray comprising a support surface configured to support at least two chemical containers containing chemicals thereon;

at least two injector assemblies, each assembly attached to one of the manifold segments such that the injector assemblies are fluidly coupled to the high pressure water channel, each injector assembly including an injector valve;

at least two spud assemblies, each spud assembly mounted to the corresponding manifold segment and fluidly coupled to the corresponding injector assembly and configured to be fluidly coupled to a corresponding chemical container;

wherein selective actuation of the injector valves allows high pressure water to flow into the injector assembly from the high pressure water channel, the high pressure water creating a vacuum condition in the corresponding injector assembly such that chemical is drawn from the corresponding chemical container through the corresponding spud assembly and into a chemical flow channel, whereby the chemical enters the injector assembly and mixes with the high pressure water such that a mixed solution of chemical and water is dispensed from the injector assembly.

2. The chemical dispensing system of claim 1, wherein an interconnecting member is positioned between each manifold segment, said interconnecting member fluidly connecting the high pressure water channels of each manifold segment.

3. The chemical dispensing system of claim 2, wherein the interconnecting member fluidly connects the chemical flow channels of adjacent manifold segments, such that flow from the corresponding chemical containers is arranged in a ganged flow arrangement.

4. The chemical dispensing system of claim 2, wherein the interconnecting member plugs the chemical flow channels of adjacent manifold segments, such that flow from the corresponding chemical containers is arranged in an isolated flow arrangement.

5. The chemical dispensing system of claim 1, wherein each injector assembly includes a venturi injector body having a high pressure water inlet, an injector inlet and a mixed solution outlet, wherein flow through the high pressure water inlet is fluidly controlled by the corresponding injector valve, and wherein the chemical is drawn into the injector inlet in response to the vacuum condition formed in a venturi throat such that mixed solution is dispensed from the mixed solution outlet.

6. The chemical dispensing system of claim 5, wherein the chemical flow channel is defined within the manifold segments and wherein the injector inlet is mounted to the corresponding manifold segment such that the injector inlet is fluidly connected to the chemical flow channel.

7. The chemical dispensing system of claim 1, further comprising a keying arrangement between each tray and each chemical container, whereby if the keying system is not satisfied when each chemical container is positioned on the tray, the corresponding chemical container and spud assembly cannot be fluidly engaged.

8. The chemical dispensing system of claim 7, wherein the keying arrangement comprises a pin arrangement on a support surface of each tray that is configured to engage with a corresponding channel on a floor surface of each chemical container, whereby the chemical container fluidly engages the spud assembly when the channel corresponds with the pin arrangement such that the chemical container is seated on the tray.

9. The chemical dispensing system of claim 1, wherein the manifold member attaches to a base plate that resides on a support surface or floor.

10. The chemical dispensing system of claim 9, wherein the manifold member includes a lower receiver and the base plate includes a mounting post, and wherein the lower receiver is positionable over the mounting post such that the manifold member can be rotated relative to the base plate.

* * * * *